United States Patent [19]

Fröhlich et al.

[11] 4,454,912

[45] Jun. 19, 1984

[54] SWAB HOIST USE THEREOF IN CONVEYING CRUDE OIL AND NATURAL GAS

[75] Inventors: Johann L. Fröhlich; Josef Gamperl; Peter Hanak, all of Vienna; Gerhard Wawra, Prottes, all of Austria

[73] Assignee: OMV Aktiengesellschaft, Vienna, Austria

[21] Appl. No.: 291,147

[22] Filed: Aug. 7, 1981

[30] Foreign Application Priority Data

Aug. 12, 1980 [AT] Austria ..... 4128/80

[51] Int. Cl.[3] ..... E21B 37/10

[52] U.S. Cl. ..... 166/53; 166/72; 166/385; 254/361

[58] Field of Search ..... 166/53, 70, 72, 73, 166/385; 254/361, 325, 274; 175/170

[56] References Cited

U.S. PATENT DOCUMENTS

| | | | |
|---|---|---|---|
| 2,625,835 | 1/1953 | Marek | 175/170 |
| 3,606,256 | 9/1971 | Ouretveit | 254/361 |
| 4,024,913 | 5/1977 | Grable | 166/72 |
| 4,148,464 | 4/1979 | Fog et al. | 254/361 |
| 4,169,580 | 8/1979 | Hatlapa et al. | 254/361 |
| 4,227,680 | 8/1980 | Hrescak | 254/361 |

FOREIGN PATENT DOCUMENTS

| | | |
|---|---|---|
| 782381 | 2/1956 | United Kingdom . |
| 936316 | 3/1961 | United Kingdom . |
| 1017260 | 11/1963 | United Kingdom . |
| 1070448 | 12/1965 | United Kingdom . |
| 1143102 | 2/1966 | United Kingdom . |
| 1141769 | 10/1967 | United Kingdom . |
| 1196041 | 12/1967 | United Kingdom . |
| 1212441 | 1/1968 | United Kingdom . |
| 1529331 | 3/1976 | United Kingdom . |
| 1555183 | 11/1976 | United Kingdom . |

OTHER PUBLICATIONS

Prospectus, Wilson Mfg. Co., pp. 7603–7615.

*Primary Examiner*—Stephen J. Novosad
*Assistant Examiner*—William P. Neuder
*Attorney, Agent, or Firm*—Seidel, Gonda & Goldhammer

[57] ABSTRACT

The invention relates to a swab hoist for use in conveying crude oil and natural gas having a cable drum and a driving motor for the cable drum.

It is the object of the invention to provide a swab hoist of improved properties.

This is achieved according to the invention by providing a hydraulic drive for the transmission of force from the driving motor to the cable drum. The hydraulic drive consists of a hydraulic pump driven by the driving motor, a hydraulic motor connected to the cable drum and a control means, in particular a pressure-reducing means, all connected to one another by means of pressure lines.

14 Claims, 5 Drawing Figures

Fig. 2
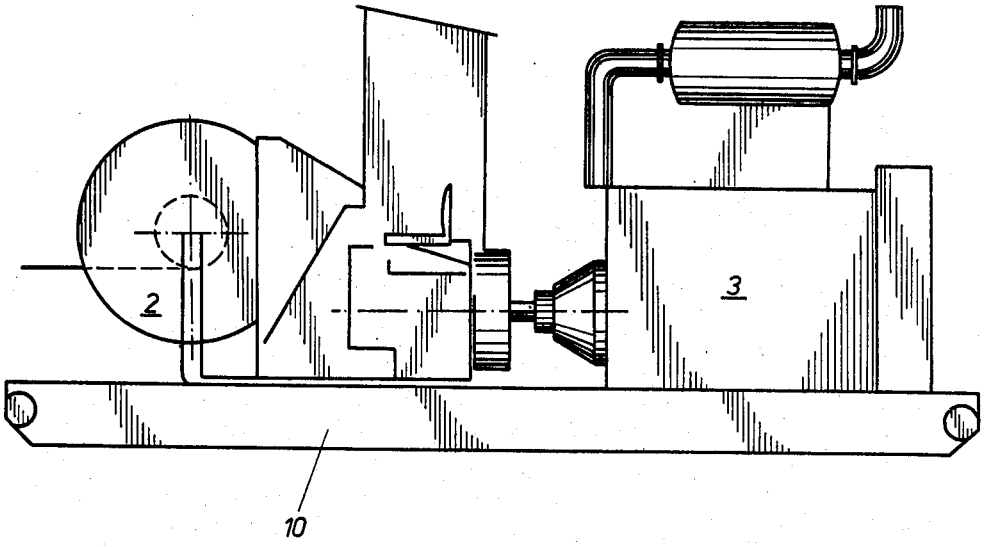
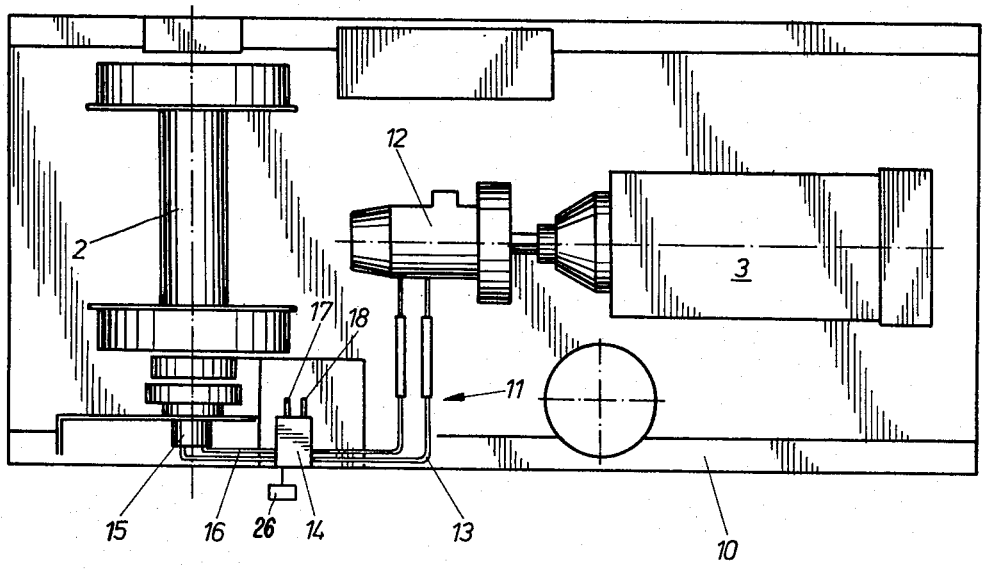
Fig. 3

SWAB HOIST USE THEREOF IN CONVEYING CRUDE OIL AND NATURAL GAS

The invention relates to a swab hoist for use in conveying crude or mineral oil and natural gas having a cable or rope drum and a driving motor for said drum.

The term swab hoist is used for devices by means of which a piston is lowered by means of a cable or rope into a drilled well filled with flushing water in the course of swabbing the well and is then hoisted up again in order to activate the well. In hoisting up the piston, its rate must be adjusted to the rate of the following jet of crude oil or natural gas, which means that the hoisting rate of the cable on the drum of the swab hoist must increase in proportion to the hoisting level of the piston in the well.

In known swab hoists, the cable or rope drum is driven by means of a chain drive and a mechanical clutch by a diesel motor. The adjustment of the hoisting rate of the cable to that of the onrushing jet of mineral oil or natural gas is difficult and the construction of the chain drive requires that the diesel motor be arranged with its axis parallel to the axis of the drum.

It is the object of the invention to avoid these disadvantages and to provide a swab hoist of improved properties.

This object is achieved according to the invention in a swab hoist of the type initially mentioned by providing a hydraulic drive for the transmission of force from the driving motor to the cable drum. The hydraulic drive consists of a hydraulic pump driven by the driving motor, a hydraulic motor connected to the cable drum and a control means, in particular a pressure-reducing means, all connected to one another by means of pressure lines.

SUMMARY OF THE INVENTION

By use of a hydraulic drive for the cable drum, the rate of hoisting up the piston in the well can be infinitely varied so as to optimally adjust it to the onrushing jet of mineral oil or natural gas. Moreover, the position of the diesel motor can be selected independently of the position of the cable drum, so that if necessary, a diesel motor of higher capacity and thus larger dimensions can be used independently of the maximum length of the cable drum of 2.5 meters determined by the width of the roadway. By omission of the chain drive and the clutch, the entire width of the roadway of 2.5 meters can be used for the length of the cable drum, which means that more cable can be wound on the drum as compared to known swab hoists, so that the use of the swab hoist can be extended to deeper wells.

According to an embodiment of the invention, the longitudinal axis of the driving motor is arranged essentially transversely in relation to the axis of the cable drum. This arrangement permits the use of a driving motor of any given dimensions, and thus capacity, independently of the length of the cable drum.

It is further of advantage if the hydraulic motor serves as a bearing or support for the cable drum. This simplifies construction, on the one hand, and allows for a better utilization of the width of the roadway of 2.5 meters maximum by the length of the drum, on the other hand.

It is practical to provide a freewheel between the hydraulic motor and the cable drum. This allows for a saving in energy. Of particular advantage is the provision of a hydraulic motor provided with freewheel.

According to a preferred embodiment of the invention, the pressure lines between the hydraulic pump and the hydraulic motor are provided with at least two hydraulic connections for further tools used in conveying mineral oil or natural gas, such as, for instance, tubing pliers or the like.

The invention is described in detail under reference to the drawing showing an embodiment of the object of the invention.

FIG. 2 shows the swab hoist in enlarged scale;

FIG. 3 shows a plan view of FIG. 2;

DETAILED DESCRIPTION

Figure 1:
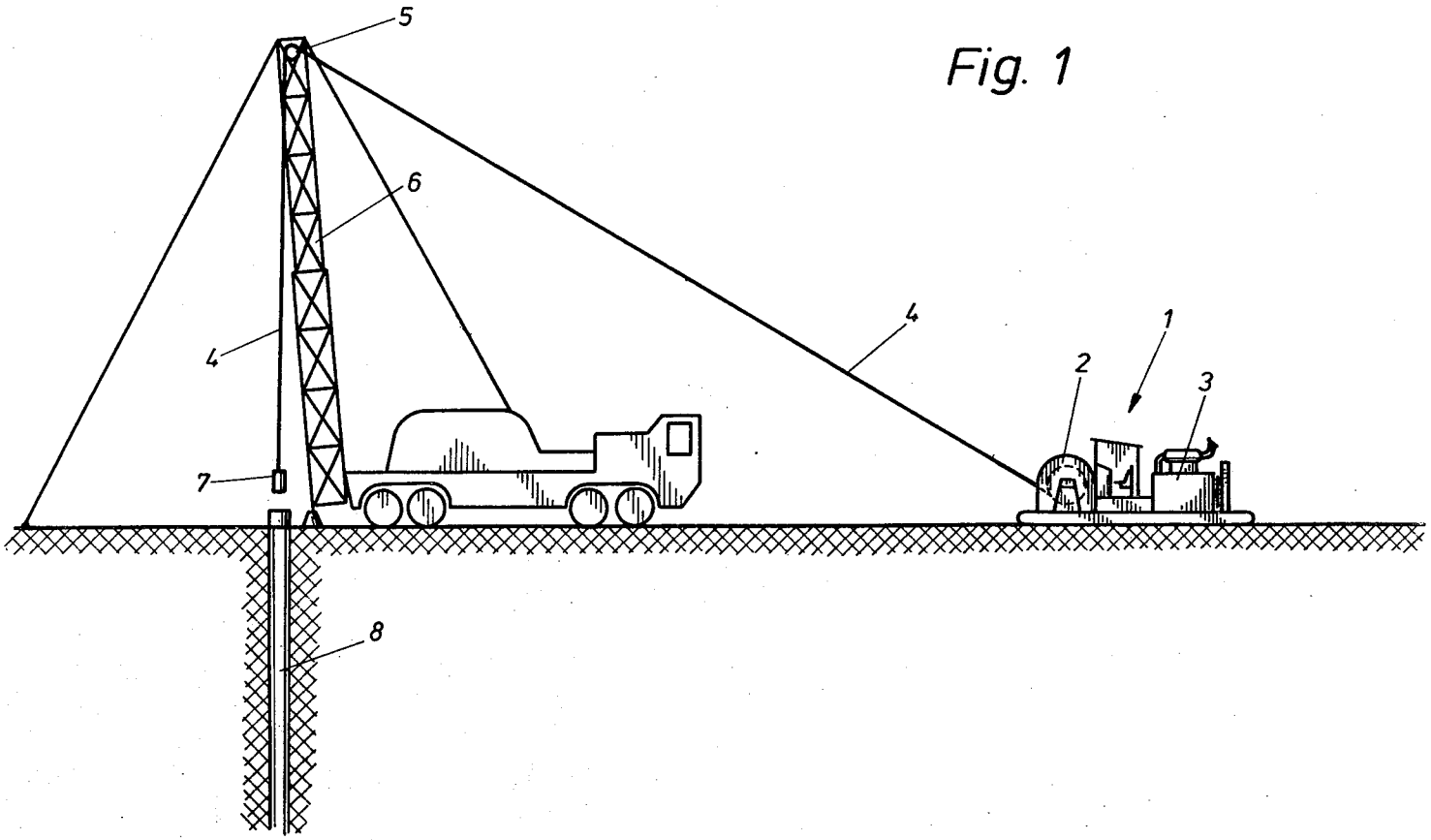
FIG. 1 shows the use of a swab hoist in drilling a well in an oilfield.

FIG. 1 shows the swab hoist 1 comprising a cable or rope drum 2 and a driving motor 3 for the cable drum, at use in an oilfield. The rope or cable (wire) coming from the cable drum 2 runs over a guide pulley 5 of a mobile drilling rig 6 and supports on its free end a piston 7 which is lowered after cleaning the well 8 into the open well 8 filled with water, with a nonreturn valve provided in the piston 7 permitting the lowering into the well. For activation of the well, the piston 7 is then hoisted by the swab hoist by means of the cable 4, at this time, the nonreturn valve in the piston is closed. The water is removed from the well 8 by means of the top side of the piston and the crude oil streams up on the underside of the piston, with the pressure of the crude oil on the piston increasing in proportion to the hoisting level. The stroke rate of the piston 7 must be adjusted to the streaming rate of the crude oil jet as precisely as possible.

Figure 4:
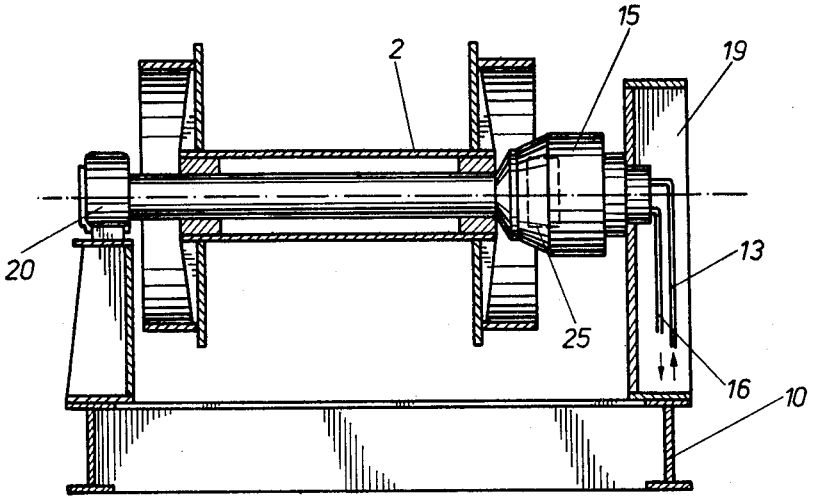
FIG. 4 shows a sectional view of the swab hoist along line IV—IV in FIG. 3.

FIGS. 2 to 4 are detailed illustrations of the swab hoist according to the invention. The cable drum 2 and the diesel driving motor 3 are arranged on a common, approximately rectangular frame 10. The width of this frame 10 and the length of the cable drum 2 arranged transversely in relation to the frame amount to a maximum of 2.5 meters, so that the swab hoist can be conveyed from one drilling site to another on public roads. The axis of the diesel motor 3 extends parallel in relation to the longitudinal direction of the frame 10, which means transverse in relation to the axis of the cable drum 2, so that a correspondingly high driving capacity can be provided, which in a diesel motor of series construction known per se is approximately proportional to the length of the diesel motor, i.e. the number of cylinders.

The transmission of force from the driving motor 3 to the cable drum 2 is effected by a hydraulic drive which bears the overall reference number 11. The hydraulic drive comprises a hydraulic pump 12 driven, i.e. entrained, in rotation, by the driving motor 3. The pump 12 is connected via a pressure line 13 and a control means 14 to a hydraulic motor 15 assembled with the cable drum and driving it. From the hydraulic motor 15, a pressure line 16 leads back to the hydraulic pump 12. The hydraulic pump and the hydraulic motor are preferably radial piston or axial piston construction units and the control means preferably comprises a pressure-reducing valve for adjustment of the hydraulic pressure. The control means can be actuated manually or be actuated automatically by means of a servo control 26 depending upon the pressure exerted on the piston. In the pressure lines 13, 16 between the hydraulic pump 12 and the hydraulic motor 15, two or more connections 17, 18 can be provided without difficulty for connecting further tools, such as tubing pliers or the like, used in conveying mineral oil or natural gas.

FIG. 4 shows that the hydraulic motor 15 simultaneously serves as a bearing or support for the cable drum 2. The hydraulic motor 15 is attached to the frame 10 by means of a bracket 19. Thus, only one more lateral bearing 20 is required for supporting the cable drum 2.

This embodiment is much simpler than a known swab hoist driven by a chain drive and requires much less space in the axial direction of the drum.

Figure 5:
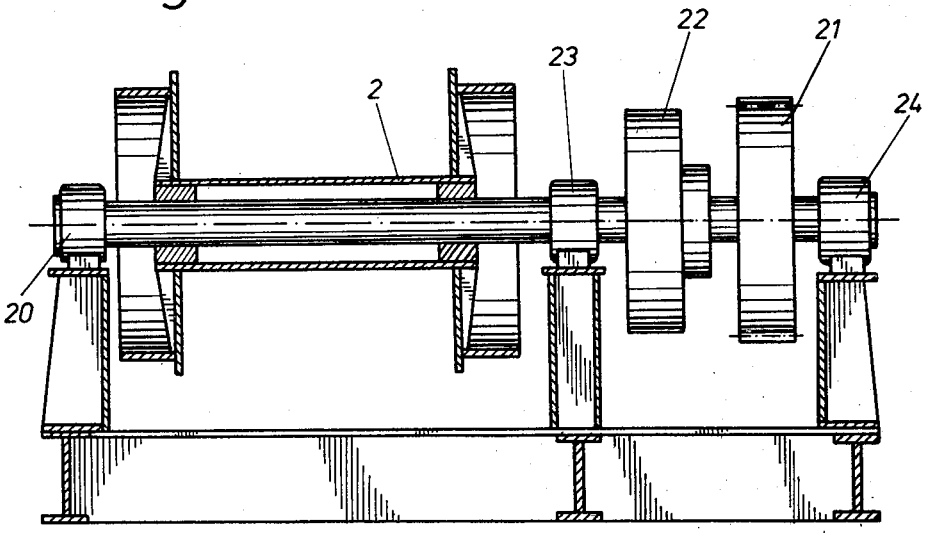
FIG. 5 is the corresponding sectional view of a known swab hoist.

This is evident from the juxtaposition of FIGS. 4 and 5, the latter showing an analogous sectional view of a known swab hoist. In the known embodiment according to FIG. 5, the cable drum 2 is driven by means of a chain drive 21 via a clutch 22, two more bearings 23, 24 being required in addition to the bearing 20.

As already mentioned, the swab hoist according to the invention can be provided with a freewheel in order to save energy. It is particularly advantageous to use a hydraulic motor provided with freewheel 25 according to FIG. 4. The swab hoist according to the invention can also be driven in both rotating directions.

We claim:

1. Swab hoist for use in conveying crude oil and natural gas comprising a cable drum, a cable which is provided with a piston movable in a well, a driving motor for the cable drum and a hydraulic drive for the transmission of force from the driving motor to the cable drum, said hydraulic drive comprising a hydraulic pump driven by the driving motor, a hydraulic motor connected to the cable drum, said hydraulic motor formed as a bearing for the cable drum, and a control means for adjusting the rate of the piston in the well, said hydraulic pump, hydraulic motor and control means being connected by pressure lines, said control means being controlled in response to the pressure of the crude oil and natural gas on the piston in the well.

2. Swab hoist according to claim 1, wherein the longitudinal axis of the driving motor is arranged essentially transversely in relation to the axis of the cable drum.

3. Swab hoist according to claim 1, wherein a freewheel is arranged between the hydraulic motor and the cable drum.

4. Swab hoist according to claim 1, wherein a freewheel is arranged within the hydraulic motor itself.

5. Swab hoist for use in conveying crude oil and natural gas comprising a cable drum, a cable which is provided with a piston movable in a well, a driving motor for the cable drum and a hydraulic drive for the transmission of force from the driving motor to the cable drum, said hydraulic drive comprising a hydraulic pump driven by the driving motor, a hydraulic motor connected to the cable drum, said hydraulic motor formed as a bearing for the cable drum, and a freewheel arranged between the hydraulic motor and the cable drum, said freewheel being arranged within the hydraulic motor itself, and a control means for adjusting the rate of the piston in the well, said hydraulic pump, hydraulic motor and control means being connected by pressure lines, said control means being controlled in response to the pressure of the crude oil and natural gas on the piston in the well.

6. Swab hoist according to claim 5, wherein at least two hydraulic connections for connecting further tools used in conveying crude oil or natural gas are provided in the pressure lines between the hydraulic pump and the hydraulic motor.

7. Swab hoist according to claim 5, wherein the control means is automatically controlled by a servo motor in response to the pressure of the crude oil or natural gas in the well.

8. Process for conveying crude oil and natural gas from a drilled well comprising:

(a) raising and lowering a piston by means of a cable;

(b) winding said cable on a cable drum by means of a driving motor; and (c) transmitting force from the driving motor to the cable drum by means of a hydraulic drive, said hydraulic drive comprising a hydraulic pump driven by the driving motor, a hydraulic motor connected to the cable drum, said hydraulic motor formed as a bearing for the cable drum, a control means for adjusting the rate of the piston in the well, said hydraulic pump, hydraulic motor and control means being connected by pressure lines, said control means being controlled in response to the pressure of the crude oil and natural gas on the piston in the well.

9. Process according to claim 24, wherein the longitudinal axis of the driving motor is arranged essentially transversely in relation to the axis of the cable drum.

10. Process according to claim 24, wherein a freewheel is arranged between the hydraulic motor and the cable drum.

11. Process according to claim 24, wherein the freewheel is arranged within the hydraulic motor itself.

12. Process for conveying crude oil and natural gas from a drilled well comprising:

(a) raising and lowering a piston by means of a cable;

(b) winding said cable on a cable drum by means of a driving motor;

(c) transmitting force from the driving motor to the cable drum by means of a hydraulic drive, said hydraulic drive comprising a hydraulic pump driven by the driving motor, a hydraulic motor connected to the cable drum, said hydraulic motor formed as a bearing for the cable drum, and a freewheel arranged between the hydraulic motor and the cable drum, said freewheel being arranged within the hydraulic motor itself, and a control means for adjusting the rate of the piston in the well, said hydraulic pump, hydraulic motor and control means being connected by pressure lines, said control means being controlled in response to the pressure of the crude oil and natural gas on the piston in the well.

13. Process according to claim 12, wherein at least two hydraulic connections for connecting further tools used in conveying crude oil or natural gas are provided in the pressure lines between the hydraulic pump and the hydraulic motor.

14. Process according to claim 12, wherein the control means is automatically controlled by a servo motor in response to the pressure of the crude oil or natural gas in the well.

* * * * *